United States Patent [19]

Suzuki et al.

[11] Patent Number: 4,676,737

[45] Date of Patent: Jun. 30, 1987

[54] BURNER

[75] Inventors: Jiro Suzuki, Nara; Atsushi Nishino; Masato Hosaka, both of Osaka; Yukiyoshi Ono; Yasuhiro Takeuchi, both of Osaka, all of Japan

[73] Assignee: Matsushita Electric Industrial Co., Ltd., Japan

[21] Appl. No.: 772,937

[22] Filed: Sep. 5, 1985

[30] Foreign Application Priority Data

Sep. 6, 1984 [JP] Japan ..... 59-186750
Oct. 3, 1984 [JP] Japan ..... 59-207403
Oct. 3, 1984 [JP] Japan ..... 59-207405

[51] Int. Cl.[4] ..... F23D 14/12
[52] U.S. Cl. ..... 431/328; 126/92 B
[58] Field of Search ..... 431/7, 328; 126/92 R, 126/92 AC, 92 C, 92 B, 91 R, 91 A

[56] References Cited

U.S. PATENT DOCUMENTS 1,308,364 7/1919 Lucke ..... 431/328
1,347,631 7/1920 Herck ..... 431/328 X
2,087,031 7/1937 Hays ..... 431/328 X
3,191,659 6/1965 Weiss ..... 431/328
3,199,505 8/1965 Lloyd ..... 431/328 X
3,291,189 12/1966 Schade, Jr. ..... 431/328 X
3,683,058 8/1972 Partiot ..... 431/328
4,224,019 9/1980 Dilmore ..... 431/328
4,368,029 1/1983 Lacroix ..... 431/328 X
4,502,465 3/1985 Yoshinaga et al. ..... 431/328 X
4,608,012 8/1986 Cooper ..... 431/328

FOREIGN PATENT DOCUMENTS

18961/70 8/1970 Australia .

*Primary Examiner*—Margaret A. Focarino
*Attorney, Agent, or Firm*—Lowe, Price, LeBlanc, Becker & Shur

[57] ABSTRACT

A burner has a combustion body supporting a platinum-group catalyst. An air-fuel mixture is supplied to the combustion body and combusted primarily on the upstream surface of the combustion body. A heat-transmissive body is disposed for discharging heat radiation from the upstream surface of the combustion body. The burner has a greater heat radiation efficiency and a wider range in which the amount of combustion is variable than conventional catalytic combustion burners.

8 Claims, 6 Drawing Figures

BURNER

BACKGROUND OF THE INVENTION

The present invention relates to a burner for combusting a gas or liquid fuel to warm rooms, and dry and heat objects.

Known burners for producing high heat radiation include Schwank burners and catalytic combustion burners. Generally, the Schwank burners are widely used for obtaining heat radiation. However, the Schwank burners are disadvantageous in that their heat radiation ratio is limited and they are incapable of adjusting the amount of combustion due primarily to back fire. To prevent the back fire from occurring, the Schwank burner system includes a combustion body having combustion holes of extremely small diameter for enabling an air-fuel mixture to flow therein at a speed higher than the rate of combustion of the air-fuel mixture in the combustion holes. Therefore, the flame is normally generated downstream of the combustion body in the direction in which the air-fuel mixture flows. If the speed of flow of the air-fuel mixture were reduced below the combustion rate, then the flame would go upstream to result in a backfire. Thus, it would be difficult to change the speed of flow of the air-fuel mixture, and hence to change the amount of combustion. Since the flame is produced downstream of the combustion body at all times, the heat of combustion is not sufficiently transmitted to the combustion body, but discharged as waste heat. This is the reason why the heat radiation ratio of the Schwank burner system is limited to a low level ranging from about 30 to 40%.

The catalytic combustion burner has been developed in recent years to solve the problems of the Schwank burner. The general arrangement of the catalytic combustion burner is similar to that of the Schwank burner, except that a combustion catalyst is supported by the combustion body which is composed of a nonwoven fabric made of heat-resistant fibers such as of alumina. The air-fuel mixture supplied to the combustion body is burned at a relatively low temperature in the presence of the catalyst. Since the fuel is burned at a low temperature, backfires are less liable to take place and the amount of combustion can therefore be varied. As the fuel is combusted in the combustion body in its entirety, the combustion body is well heated by the heat of combustion so that the heat radiation ratio can be increased up to about 50%. Nevertheless, the Schwank burners still find wider use in domestic and industrial fields than the catalytic combustion burners because the cost performance of the catalytic combustion burners is low for the reasons that the attained increase in the heat radiation ratio is not good considering the cost of the expensive catalyst used and the range in which the amount of combustion can be varied is not large.

SUMMARY OF THE INVENTION

It is an object of the present invention to provide a burner capable of warming, heating and drying objects more effectively than conventional burners by increasing its heat radiation ratio or efficiency.

Another object of the present invention is to provide a burner in which the amount of combustion can be varied in a greater range than conventional burners.

According to the present invention, a burner includes a mixer for mixing fuel and air, an air-fuel mixture chamber disposed downstream of the mixer in communication therewith, a combustion body disposed in the air-fuel mixture chamber and supporting a platinum-group catalyst, the combustion body having a pluraltiy of combustion holes, and a heat-transmissive body disposed in the air-fuel mixture chamber in confronting relation to at least an upstream surface of the combustion body.

BRIEF DESCRIPTION OF THE DRAWINGS

The present invention will be described in detail by way of illustrative example with reference to the accompanying drawings, in which.

DETAILED DESCRIPTION

Figure 1:
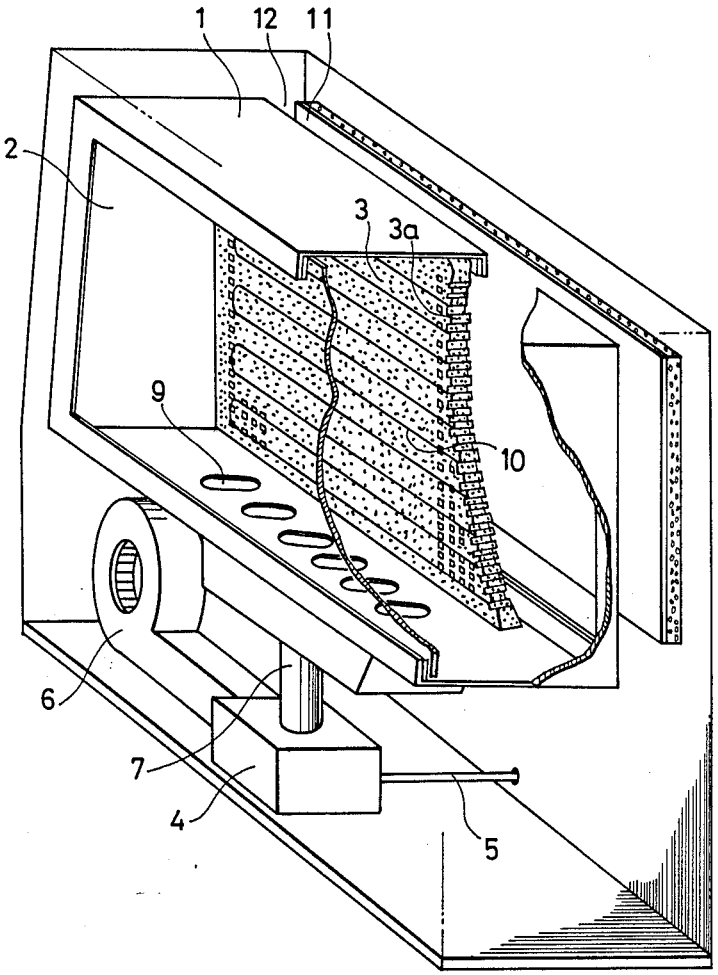
FIG. 1 is a perspective view, partly cut away, of a burner according to an embodiment of the present invention.
Figure 2:
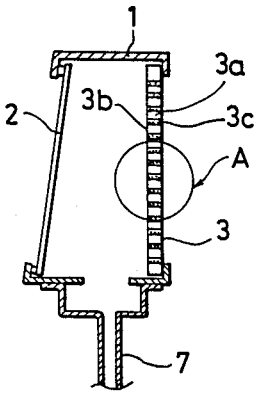
FIG. 2 is a vertical cross-sectional view of the burner shown in FIG. 1.

As shown in FIGS. 1 and 2, a burner according to an embodiment of the present invention has an air-fuel mixture chamber 1 having front and rear openings, a heat-transmissive plate 2 located in the air-fuel mixture chamber 1 and closing the front opening thereof, and a combustion body 3 located in the air-fuel mixture chamber 1 and closing the rear opening thereof. The combustion body 3 is in the form of a panel made of a heat-resistant material such as alumina, silica, cement, or the like, and has a multiplicity of combustion holes 3*a* of any desired cross-sectional shape such as a circular or rectangular cross section, the combustion holes 3*a* extending transversely through the panel. The combustion body 3 supports on its surfaces a platimum-group catalyst such as of platinum, palladium, or the like. The amount of the catalyst supported on the upstream surface 3*b* of the combustion body 3 which faces the heat-transmissive plate 2 is greater than the amount of the catalyst supported on the downstream surface 3*b* facing away from the heat-transmissive plate 2. An air-fuel mixture generator or mixer 4 is disposed below the air-fuel mixture chamber 1 for mixing a gas fuel or a liquid fuel supplied through a fuel pipe 5 and air supplied from an air blower 6 to thereby produce an air-fuel mixture or fuel gas. Where the liquid fuel is supplied to the air-fuel mixture generator 4, it is equipped with an atomizing heater or an atomizer comprising an ultrasonic vibrator, for example. The air-fuel mixture generator 4 is coupled to the air-fuel mixture chamber 1 by an air-fuel mixture pipe 7. The air-fuel mixture produced by the air-fuel mixture generator 4 flows through the air-fuel mixture pipe 7 and a plurality of holes 9 defined in the bottom of the air-fuel mixture chamber 1 into the air-fuel mixture chamber 1, i.e., between the heat-transmissive plate 2 and the combustion body 3. An electric heater 10 in a meandering pattern is attached to the combustion body 3 for heating the same up to a prescribed catalytic activation temperature. A heat reflecting plate 11 is disposed downstream of the combustion body 3 in confronting and parallel relationship to the downstream surface 3*c* of the combustion body 3, there being an exhaust passage 12 defined between the combustion body 3 and the heat reflecting plate 11.

When the air-fuel mixture is to be ignited, the combustion body 3 is heated by the electric heater 10 up to the prescribed catalytic activation temperature. After the combustion body 3 has been heated to the catalytic activation temperature, fuel and air are supplied respectively by the fuel pipe 5 and the air blower 6 into the air-fuel mixture generator 4 which produces an air-fuel mixture that is then supplied to the air-fuel mixture chamber 1 and burned therein. The combustion of the air-fuel mixture starts on the upstream surface 3*b* of the combustion body 3 in the presence of the catalyst, is continued in the combustion holes 3*a* as the air-fuel mixture flows therethrough, and ends before the air-fuel mixture reaches the downstream surface 3*c*. In the catalytic combustion, the oxidation occurs on the surface layer of the catalyst in a microscopic scale, resulting in flameless combustion. Therefore, any unburned components which has passed downstream of the downstream surface 3*c* of the combustion body 3 are virtually not oxidized since there is no outside flame. In the burner of the present invention, therefore, the oxidation must be finished before the air-fuel mixture reaches the downstream surface 3*c* of the combustion body 3, and the amount of air in the air-fuel mixture must be supplied at such a rate as to provide a required air-fuel ratio or a higher air-fuel ratio.

Figure 3:
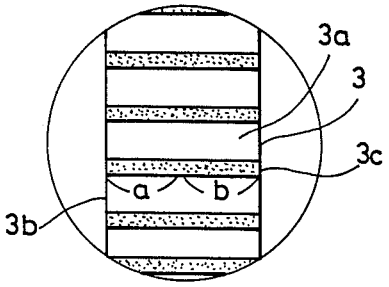
FIG. 3 is an enlarged fragmentary cross-sectional view of an encircled portion indicated by A in FIG. 2.

The burner of the invention has a high heat radiation ratio or efficiency and an amount of combustion variable in a large range. The reasons for these properties of the burner will be described with reference to FIGS. 2 and 3.

The air-fuel mixture is burned on the upstream surface 3*b* and upstream portions a of the combustion holes 3*a* of the combustion body 3. The produced heat of combustion serves to heat the combustion body 3, thus enabling it to produce radiant heat from the upstream surface 3*b*. The heat of the exhaust gas is transmitted to the combustion body 3 from downstream portions b of the combustion holes 3*a*. The heat of the exhaust gas thus transmitted to the combustion body 3 is also effective to heat the upstream surface 3*b* to enable it to generate radiant heat efficiently. The exhaust gas, from which the heat is removed in the downstream portion b of the combustion holes 3*a*, is therefore cooled to a lower temperature and passed on toward the downstream surface 3*c*. The radiant heat from the upstream surface 3*b* is discharged through the heat-transmissive plate 2 toward an object to be heated. The burner of the present invention differs from the Schwank burner or the catalytic combustion burner in that the radiant heat is obtained from the upstream surface 3*b* of the combustion body 3. In the conventional burners, heat radiation is produced from the downstream surface of the combustion body, and hence an exhaust gas which is hotter than the high-temperature radiant surface or downstream surface is produced, with the result that a large amount of heat will be lost as exhaust heat. With the arrangement of the burner of the invention, however, the heat of the high-temperature exhaust gas is converted to radiant heat by way of heat exchange, and the exhaust gas from which the heat is deprived is discharged. Therefore, the overall heat radiation ratio or efficiency of the burner is high.

Since the radiant heat from the upstream surface 3*b* is passed through the heat-transmissive plate 2, the air-fuel mixture in the air-fuel mixture chamber 1 is prevented from being subject to an undue temperature rise. The heat-transmissive plate 2 may be made of a material having a high heat transmission coefficient, such as quartz glass, silica glass, mica, or the like. Inasmuch as the air-fuel mixture is not preheated to an undue high temperature, no backfire will be produced even if the temperature of the upstream surface 3*b* is increased. This is the reason why the amount of combustion can be varied in a wide range by the burner of the present invention.

The air-fuel mixture cannot easily be ignited even if the catalyst surface is heated to a high temperature. As is well known, an air-fuel mixture can be spontaneously ignited when heated to a high temperature, or flashed when brought into contact with a flame. Since a catalyst allows an air-fuel mixture to be combusted flamelessly, the catalyst could ignite the air-fuel mixture, but could not flash the air-fuel mixture. In particular, the platinum-group catalyst employed in the burner of the invention is less liable to ignite the air-fuel mixture even when the catalyst surface is heated to a high temperature, which is known as the ability of the catalyst to suppress ignition. This catalytic effect is one of the reasons for the burner to be able to vary the amount of combustion in a wide range. Since the burner is arranged to prevent the air-fuel mixture from being overheated and the catalyst has the ability to suppress ignition of the air-fuel mixture, together with the fact that the catalytic activation of the platinum-group catalyst is kept at a low temperature, as described above, the amount of combustion in the burner can vary in a wide range from a low level to a high level.

The air-fuel mixture starts being burned from the upstream surface 3*b* of the combustion body 3 regardless of the density and speed of the air-fuel mixture. If the speed of flow of the air-fuel mixture is increased, then the combustion zone is shifted downstream in the combustion holes 3*a* and the combustion becomes more intensive toward the downstream surface 3*c*. Although the oxidation begins when the air-fuel mixture contacts the catalyst on the upstream surface 3*b*, the main oxidation zone tends to be displaced downstream as the speed of flow of the air-fuel mixture goes higher. This phenomenon would take place when the speed of the air-fuel mixture in the combustion holes 3*a* would exceed the flame propagation speed of the air-fuel mixture. Since the burner of the invention is constructed to prevent any backfire, however, it is not necessary to supply the air-fuel mixture at a high speed for backfire prevention. The heat radiation ratio or efficiency of the burner can be increased by making the speed of the air-fuel mixture in the combustion holes 3*a* lower than the flame propagation speed of the air-fuel mixture to localize the main combustion zone on the upstream surface 3*b*. Generally, if a combustible air-fuel mixture gas is brought into contact with a high-temperature surface, the gas will be ignited and backfire will be produced, putting the burner into a dangerous condition. However, the burner of the invention does not suffer such an adverse condition unless the air-fuel mixture in the burner of the invention were combusted at a very high density. In the burner of the invention, as described above, the air-fuel mixture flows at a low speed to keep the upstream surface 3*b* at a high temperature for attaining a high heat radiation ratio through heat exchange.

The reason why the amount of the catalyst on the combustion body 3 is greater upstream than downstream is that the catalytic combustion zone lies primarily on the upstream surface 3*b* and in the upstream portions a of the combustion holes 3*a*. Consequently, no catalyst is essentially required in the downstream portions of the combustion holes 3*a* which serve mainly to collect the exhaust heat. The amount of the overall catalyst used can be reduced by applying the catalyst only to the upstream surface 3*b*. Alternatively, the catalyst may be employed in a greater amount upstream than downstream, as in the illustrated embodiment, for improved catalytic combustion characteristics. The catalyst provided downstream in the smaller quantity is effective in purifying slight unburned materials such as CO which have not been completely burned in the upstream combustion zone. Where the catalyst is used for the purpose of purifying the exhaust gas, the amount thereof may be smaller than that of the catalyst used in the upstream zone for the combustion of the air-fuel mixture.

The radiant heat emitted from the upstream surface 3*b* of the combustion body 3 is transmitted through the heat-transmissive plate 2 to heat the object. However, the heat radiation is partially absorbed or reflected by the heat-transmissive plate 2 and directed downstream. This downstream heat radiation through the combustion holes 3*a* and the heat radiation generated from the downstream surfaace 3*c* of the combustion body 3 are directed away from the object being heated. Such radiant heat directed downstream is reflected back through the combustion holes 3*a* by the heat reflecting panel 11 disposed substantially parallel to the combustion body 3. Part of the returned radiant heat tends to be reflected back and forth between the heat-transmissive plate 2 and the heat reflecting panel 11 through the combustion body 3. On account of the heat-transmissive plate 2 transmitting part of the heat radiation therethrough at all times, however, the temperature in the air-fuel mixture chamber 1 is prevented from unduly rising and any backfire is less likely to occur. The heat reflecting panel 11 comprises a mirror surface layer made of a material having a high heat reflection or absorption ratio, such as aluminum, stainless steel, or the like for preventing heat from being transmitted therethrough by reflecting the downstream heat radiation or returning the heat upstream by way of secondary radiation. The heat reflecting panel 11 is thus effective in discharging the radiant heat intensively upstream for effectively warming or heating the object.

A burner according to another embodiment of the present invention will be described with reference to FIG. 4. The burner shown in FIG. 4 has a petroleum tank 15 for containing a liquid fuel. The fuel is drawn by a fuel feeder 16 through capillary action to a mixer comprising a heater 17 which vaporizes the liquid fuel with electrically induced heat. The vaporized fuel is then mixed with air supplied by an air blower 18. The air-fuel mixture is fed from the heater 17 through an air-fuel mixture supply pipe 19 in the direction of the arrows into a cylindrical heat-transmissive body 20. The heat-transmissive body 20 is made of a material having a heat transmission capability and a high infrared transmittivity, such as glass, mica, or the like. The cylindrical heat-transmissive body 20 is closed at its opposite ends. A rectangular combustion body 21 having a multiplicity of combustion holes 22 is longitudinally disposed in the air-fuel mixture chamber 20 so as to divide the ho11ow space in the cylindrical heat-transmissive body 20 into two halves, one of which serves as an air-fuel mixture chamber 23 and the other as an exhaust chamber 24. The end of the air-fuel mixture supply pipe 19 is connected to the air-fuel mixture chamber 23.

In operation, the air-fuel mixture supplied from the pipe 19 into the air-fuel mixture chamber 23 is combusted in the combustion holes 22 in the combustion body 21 to heat the combustion body 21 in its entirety. Part of the radiant heat generated by the combustion body 21 is transmitted through the heat-transmissive body 20 to an object located outside of the heat-transmissive body 20. Infrared rays which are absorbed by the heat-transmissve body 20 heat the same to a higher temperature, and the heated heat-transmissive body 20 produces radiant heat by way of secondary radiation to heat the object.

Usually, with a heat-transmissive body positioned between a radiant heat source and an object to be heated thereby, the heat energy from the heat source does not fully reach the object, but partially reaches the object, since the heat-transmissive body is heated itself for emitting secondary heat radiation and gives heat energy to ambient air through convection. According to the present invention, such a convection loss can be prevented and the heat radiation ratio or efficiency can be improved in the following manner:

The exhaust gas of a high temperature discharged from the combustion body 21 flows in the exhaust chamber 24 and heats the heat-transmissive body 20 to a high temperature. The heat-transmissive body 20 is heated by the exhaust gas over its full circumference by heat conduction for increased secondary heat radiation.

The heat-transmissive body 20 has a cylindrical surface having a minimum surface area which reduces the heat radiation loss due to natural convection, thus increasing the secondary heat radiation effectively. The cylindrical heat-transmissive body 20 also serves to produce heat radiation both upstream and downstream of the combustion body 21. The amount of heat radiation is therefore greater than possible with the conventional burners in which heat is radiated in one direction only. A heat reflecting panel may be disposed in the exhaust chamber 24 for reflecting heat radiation in the upstream direction.

Figure 4:
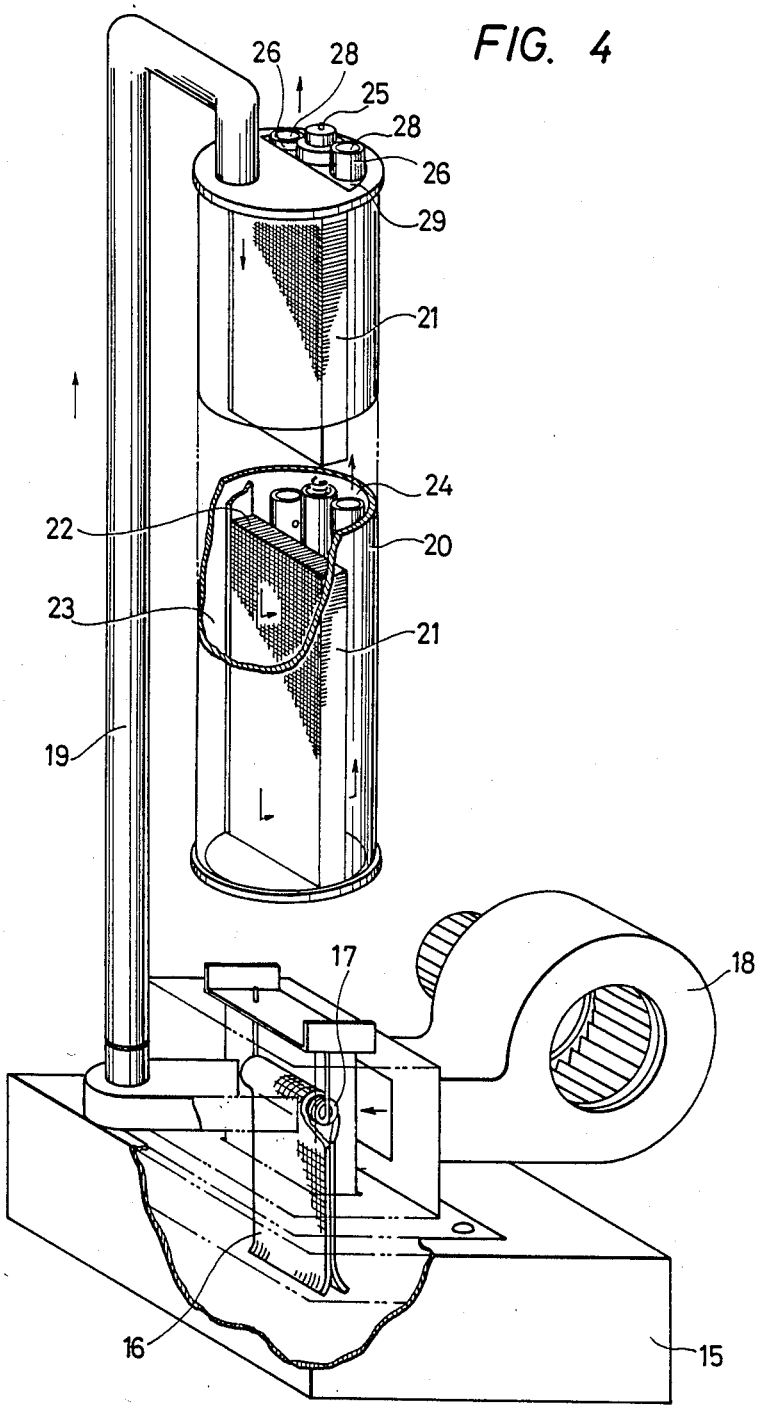
FIG. 4 is a perspective view, partly broken away, of a burner according to another embodiment of the present invention.

The burner of the embodiment shown in FIG. 4 is also advantageous in that the leakage of any unburned materials is reduced. The reasons for this is are as follows: (1) The air-fuel mixture chamber 23 and the exhaust chamber 24 are defined in the integral cylindrical seamless heat-transmissive body 20. (2) The combustion body 21 which is normally made of a material having a low thermal coefficient of expansion is not held by a member made of a metal having a high thermal coefficient of expansion, such as stainless steel. The circular ends of the heat-transmissive body 20 can easily be sealed. (3) The cylindrical heat-transmissive body 20 is more highly rigid and less thermally deformable than a case made up of flat panels and defining air-fuel mixture and exhaust chambers therein. (4) Even if the sealed portions are damaged, the unburned gas will not be discharged into atmosphere, and will be burned while flowing through the exhaust chamber 24.

Where a liquid fuel is employed in the burner, it is vaporized by the electric heater 17, but will not be condensed again on the inner wall surface of the air-fuel mixture chamber 23 since it is quickly heated to a higher temperature by the exhaust gas. If the air-fuel mixture chamber 23 were not able to be quickly heated to a higher temperature, then a large quantity of condensed liquid fuel would be deposited on the inner wall surface. Such liquid fuel deposits would be smelling when the burner would be extinguished, or would be progressively vaporized again and burned excessively. If a large quantity of liquid fuel were condensed on the heat-transmissive body 20, then the condensed liquid fuel would go through repeated cycles of vaporization and condensation, resulting in a tar-like deposit of a high boiling point which would impair the heat transmittivity and appearance of the heat-transmissive body 20. According to the present invention, the interior of the air-fuel mixture chamber 23 is heated to a higher temperature by the heat radiation from the combustion body 21, and the entire heat-transmissive body 20 is quickly heated by the exhaust gas. Therefore, the burner of the invention does not suffer the above drawbacks.

When an air-fuel gas in a combustible mixture range is in contact with the upstream surface of the combustion body 21 which is apt to be heated to a high temperature, a backfire generally tends to be produced. However, where a platinum-group catalyst is supported on the upstream surface of the combustion body 21, the air-fuel mixture gas is less liable to be flashed because of the flash suppressing mechanism of the platinum-group catalyst, when the combustion body 21 is heated. Specifically, microscopic flames in the initial stage of a backfire are produced highly closely to the platinum-group catalyst, and are prevented from growing. As the microscopic flames are generated in the vicinity of the platinum-group catalyst, the combustion body 21 supporting the catalyst is likely to be heated to high temperature, thus exhibiting a high heat radiation efficiency.

Inasmuch as the cylindrical heat-transmissive body 20 can easily discharge heat from the interior thereof, the temperatures of the combustion body 21 and the air-fuel mixture chamber 23 are not unduly increased thereby to suppress any backfire and increase the range in which the amount of combustion can be varied.

A straight igniting heater 25 is located downstream of the combustion body 21. When the igniting heater 25 is energized at the time of igniting the air-fuel mixture, the combustion body 21 can be quickly heated to a higher temperature not only by radiant heat from the igniting heater 25 but also by heat arising from natural convection. With the combustion body 21 carrying the platinum-group catalyst being thus heated, the air-fuel mixture can spontaneously be ignited by the heated combustion body 21 to start flameless combustion. As a consequence, the air-fuel mixture can start being burned without being ignited by another igniting means such as a high-voltage electric discharge.

Since the combustion body 21 is rectangular in shape, it can easily be heated by the single igniting heater. The interior of the cylindrical combustion body 21 is heated in advance by the igniting heater 25, incomplete combustion of the air-fuel mixture during the initial stage of ignition, particularly, condensation of the vaporized liquid fuel, can be prevented.

When the igniting heater 25 is energized at the time of extinguishing the burner, the catalyst can be maintained at its activating temperature to reduce the discharge of unburned components while the burner is being extinguished.

The igniting heater 25 is in the form of an electric heater comprising a heating coil disposed in a cylindrical body made of a heat-transmissive material such as quartz glass or the like for the purpose of attaining a rapid heating speed. If a sheathed heater composed of a heating coil housed in a stainless-steel pipe were employed as the igniting heater 25, the temperature of the combustion body 21 would be increased slowly and it would take a long period of time for the air-fuel mixture to ignite. With the heating coil disposed in the transparent cylindrical body, however, part of the radiant heat emitted from the heating coil is transmitted through the heat-transmissive material surrounding the heating coil to heat the combustion body 21 carrying the catalyst, thus allowing the air-fuel mixture to ignite quickly. Since the heating coil is isolated from the exhaust gas, it is less liable to be corroded.

The igniting heater 25 is preferably positioned in the exhaust chamber 24. If the igniting heater 25 were located in the air-fuel mixture chamber 23, the igniting heater 25 would obstruct the heat radiation emitted upstream of the combustion body 21. The igniting heater 25 extending through the air-fuel mixture chamber 23 would also allow unburned gas to leak from the heat-transmissive body 20.

The number and shape of igniting heaters can freely be selected dependent on the overall size of the burner.

Where the heat-transmissive body 20 is disposed substantially vertically as shown, air which rises through natural convection along the outer circumferential surface of the heat-transmissive body 20 is heated to a higher temperature as it goes higher. If the heat-transmissive body 20 were positioned horizontally, then low-temperature convection-induced air would stay around the heat-transmissive body 20 along the entire length thereof, resulting in a large heat radiation loss. With the heat-transmissive body 20 extending vertically according to the present invention, it is less subject to convection-cooling but is kept at a high temperature giving rise to a high heat radiation efficiency.

It is important that the combustion body 21 be uniform in temperature distribution because any localized temperature rise thereof would cause the air-fuel mixture to be flashed in the air-fuel mixture in the air-fuel mixture chamber 23 and shorten the service life of the catalyst on the combustion body 21. According to the present invention, the temperature distribution of the combustion body 21 is uniformized by the following two means or processes, one related to the flow of the air-fuel mixture and the exhaust gas, and the other to the flow of the exhaust gas.

The uniformization of the temperature distribution of the combustion body 21 will first be described below. The air-fuel mixture enters, at a relatively low temperature, into the air-fuel mixture chamber 23 through its upper end. As the air-fuel mixture flows downwardly in the air-fuel mixture chamber 23, it is heated progressively to a higher temperature by the heat of the combustion body 21. On the other hand, the exhaust gas discharged from the combustion holes 22 in the combustion body 21 is heated progressively to a higher temperature as it rises in the exhaust chamber 24. The exhaust gas is ejected substantially uniformly from all of the combustion holes 22 into the exhaust chamber 24. Therefore, the rate of flow of the exhaust gas is progressively greater toward the upper portion of the exhaust chamber 24. The upper portion of the exhaust chamber 24 is thus subject to an exhaust heat greater than the heat deprived by heat radiation, and hence can easily be heated to a higher temperature. Thus, the temperature of the air-fuel mixture is lower in the upper portion of the air-fuel mixture chamber 23 and higher in the lower portion thereof, whereas the temperature of the exhaust gas is lower in the lower portion of the exhaust chamber 24 and higher in the upper portion thereof. These different temperature distributions tend to offset each other to uniformize the temperature of the combustion body 21 positioned between the air-fuel mixture chamber 23 and the exhaust chamber 24. The combution body 21 is accordingly prevented from being locally overheated or cooled to thereby prevent backfires or incomplete combustion. The heat radiation efficiency of the combustion body 21 can also be increased as it is uniformly heated to a higher temperature. Because the exhaust gas and the air-fuel mixture flow in opposite directions with the combustion body 21 interposed therebetween, the heat of the exhaust gas can preheat the air-fuel mixture. The preheating of the air-fuel mixture serves to increase the temperature at which the air-fuel mixture is combusted, so that the amount of heat radiation from the combustion body 21 can be increased furthermore. The preheating of the air-fuel mixture by the heat of the exhaust gas is effected not only through the combustion body 21, but also by the outer wall of the exhaust chamber 24 and the air-fuel mixture chamber 23, i.e., the heat-transmissive body 20. The temperature distribution of the combustion body 21 is thus uniformized for the reason described above.

Figure 5:
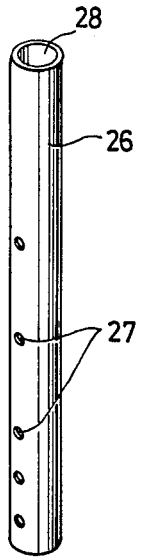
FIG. 5 is a perspective view of a flow uniformizer.
Figure 6:
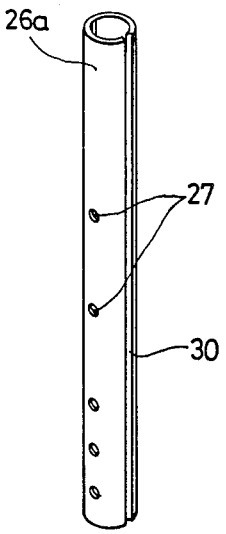
FIG. 6 is a perspective view of a modified flow uniformizer.

The second means for equalizing the temperature distribution of the combustion body 21 is as follows: Two flow uniformizers 26 in the form of hollow pipes are disposed in the exhaust chamber 24 in confronting and parallel relation to the combustion body 21 for uniformizing the flow of the exhaust gas. The flow uniformizers 26 are made of a heat-resistant metal which is a good thermal conductor. Each of the flow uniformizers 26 has a plurality of exhaust holes 27, as shown in FIG. 5, which are irregularly spaced such that they are densely spaced in the lower one-third of the length of the flow uniformizer 26, coarsely spaced in the middle one-third thereof, and no exhaust hole is formed in the upper one-third thereof. Each flow uniformizer 26 is closed at its lower end and open at its upper end as an exhaust outlet 28. According to a modification illustrated in FIG. 6, a flow uniformizer **26*a* may have a longitudinal slot 30 extending throughout its entire length. The igniting heater 25 extends linearly between and parallel to the flow uniformizers 26 longitudinally through the exhaust chamber 24. The upper closed end of the heat-transmissive body 20 has an opening 29 through which the igniting heater 25 and the flow uniformizers 26 project, the opening 29** doubling as an exhaust outlet.

It would be impossible to place flow uniformizers in the air-fuel mixture chamber 23 for uniformizing the flow of the air-fuel mixture therein since such flow uniformizers would obstruct heat radiation.

The flow uniformizers 26 placed in the exhaust chamber 24 serve to heat the catalyst-supporting combustion body 21 unformly since the densely spaced exhaust holes 27 in the lower one-third of the flow uniformizers 26 draw more of the air-fuel mixture and thus uniformize the overall flow of the air-fuel mixture which would otherwise have less tendency to reach the lower portion of the combustion body 21 after having been supplied from the upper end of the air-fuel mixture chamber 23.

The density distribution of the exhaust holes 27 may be selected as desired dependent on the diameter and length of the heat-transmissive body 20 and the shapes of the air-fuel mixture chamber 23 and the exhaust chamber 24. Basically, however, it is necessary that more or larger exhaust holes be defined in the flow uniformizers 26 at an area of the air-fuel mixture chamber 23 which the air-fuel mixture would normally find greatest difficulty to reach, i.e., which is remotest from the area of the air-fuel mixture chamber 23 through which the air-fuel mixture is suplied, and fewer or smaller exhaust holes be defined closely to the air-fuel mixture chamber area through which the air-fuel mixture is supplied.

The flow uniformizers 26 disposed in the exhaust chamber 24 are heated to a higher temperature by the heat of the exhaust gas. Since the flow uniformizers 26 are made of a metal that is a good thermal conductor and the exhaust gas flows along the outer and inner surfaces thereof, the flow uniformizers 26 can quickly and uniformly heated to a higher temperature. The temperature distribution of the combustion body 21 can also be uniformized by secondary heat radiation from the flow uniformizers 26 since a higher-temperature portion of the combustion body 21 tends to radiate heat toward the flow uniformizers 26 and a lower-temperature portion thereof tends to receive heat from the flow uniformizers 26.

Either one or both of the above two means or processes for uniformizing the combustion body 21 may be employed as desired.

A sensor (not shown) may be provided for detecting the temperature of the combustion body 21 directly or indirectly. When the combustion body 21 is heated up to an abnormally high temperature, the sensor is activated to stop or reduce the supply of the fuel to prevent the danger of backfires for better safety. It is also possible for this sensor to detect a temperature drop of the catalyst surface arising, for example, from a reduction in the oxygen density in the room that is warmed by the burner, for thereby stopping the combustion in the burner. The sensor may comprise a thermocouple, a thermistor, or a pyroelectric detector, for example.

Although certain preferred embodiments of the present invention have been shown and described in detail, it should be understood that various changes and modifications may be made therein without departing from the scope of the appended claims.

What we claim is:

1. A burner comprising:

(a) a mixer for mixing a fuel and air into an air-fuel mixture;

(b) an air-fuel mixture chamber disposed downstream of said mixer in communication therewith with respect to a direction in which said air-fuel mixture flows;

(c) a combustion body disposed in said air-fuel mixture chamber and supporting a platinum-group catalyst on upstream and downstream surfaces thereof with respect to said direction, said combustion body having a plurality of combustion holes; and (d) a heat-transmissive body for transmitting heat from said combustion body therethrough, disposed in said air-fuel mixture chamber in confronting relation to at least an upstream surface of said combustion body with respect to said direction, said air-fuel mixture chamber being defined substantially between said combustion body and said heat-transmissive body.

2. A burner according to claim 1, wherein said heat-transmissive body and said combustion body extend substantially vertically.

3. A burner comprising:

(a) a mixer for mixing a fuel and air into an air-fuel mixture;

(b) an air-fuel mixture chamber disposed downstream of said mixer in communication therewith with respect to a direction in which said air-fuel mixture flows, for being supplied with said air-fuel mixture from said mixer;

(c) a combustion body disposed in said air-fuel mixture chamber and supporting a platinum-group catalyst on upstream and downstream surfaces thereof with respect to said direction, said combustion body having a plurality of combustion holes; and (d) a heat-transmissive body for transmitting heat from said combustion body therethrough, disposed in said air-fuel mixture chamber in confronting relation to at least said upstream surface of said combustion body, said air-fuel mixture chamber being defined substantially between said combustion body and said heat-transmissive body, said combustion body being arranged and means associated with the arrangement of the combustion body for enabling said air-fuel mixture to combust substantially entirely on said upstream surface.

4. A burner comprising:

(a) a mixer for mixing a fuel and air into an air-fuel mixture;

(b) a cylindrical heat-transmissive body for transmitting heat therethrough, communicating with said mixer;

(c) a combustion body disposed in said heat-transmissive body and extending along a diametrical plane therein, said combustion body dividing the interior of the heat-transmissive body into two spaces each of semicircular cross section, said combustion body supporting a platinum-group catalyst and having a plurality of combustion holes; and (d) one of said spaces serving as an air-fuel mixture chamber for being supplied with said air-fuel mixture from said mixer, and the other of said spaces as an exhaust chamber for discharging an exhaust gas emitted from said combustion body.

5. A burner according to claim 4, wherein said exhaust chamber is disposed downstream of said combustion body with respect to a direction in which said air-fuel mixture flows, and wherein said air-fuel mixture and said exhaust gas flow in opposite directions in said air-fuel mixture chamber and said exhaust chamber, respectively, with said combustion body disposed therebetween.

6. A burner according to claim 4, including a straight igniting heater extending through said heat-transmissive body.

7. A burner according to claim 5, including an igniting heater disposed in said exhaust chamber.

8. A burner according to claim 4, wherein said exhaust chamber is disposed downstream of said combustion chamber with respect to a direction in which said air-fuel mixture flows, including at least one flow uniformizer disposed in said exhaust chamber and having a plurality of exhaust holes for uniformizing the flow of an exhaust gas from said combustion body.

* * * * *